US005805956A

United States Patent [19]

Kawai et al.

[11] Patent Number: 5,805,956

[45] Date of Patent: Sep. 8, 1998

[54] ELECTROPHOTOGRAPHIC IMAGE FORMING APPARATUS CAPABLE OF SETTING IMAGE FORMING CONDITIONS AND METHOD FOR SETTING IMAGE FORMING CONDITIONS IN AN ELECTROPHOTOGRAPHIC IMAGE FORMING APPARATUS

[75] Inventors: Atsushi Kawai, Aichi-Ken; Tetsuya Sakai, Toyokawa, both of Japan

[73] Assignee: Minolta Co., Ltd., Osaka, Japan

[21] Appl. No.: 669,922

[22] Filed: Jun. 25, 1996

[30] Foreign Application Priority Data

Jun. 30, 1995 [JP] Japan ..... 7-165259

[51] Int. Cl.[6] ..... G03G 15/00

[52] U.S. Cl. ..... 399/46; 399/48; 399/50; 399/55

[58] Field of Search ..... 399/42, 46, 48–50, 399/55, 56

[56] References Cited

U.S. PATENT DOCUMENTS 5,029,314 7/1991 Katsumi et al. ..... 399/44
5,499,079 3/1996 Kinoshita et al. ..... 399/46
5,504,557 4/1996 Morita ..... 399/56

FOREIGN PATENT DOCUMENTS 3-054576 3/1991 Japan .
3-107873 5/1991 Japan .
3-166559 7/1991 Japan .

*Primary Examiner*—William J. Royer
*Attorney, Agent, or Firm*—Burns, Doane, Swecker & Mathis, LLP

[57] ABSTRACT

An electrophotographic image forming apparatus is disclosed that enables both photosensitive member and developer to be used to the full limit of their service lives. The image forming apparatus selectively adjusts one or another of either a surface potential setting of the photosensitive member or a developing bias voltage in accordance with a condition of the photosensitive member and the developer which is determined based on a fog appearance in output image and value of charged potential of the photosensitive member surface.

29 Claims, 10 Drawing Sheets

ELECTROPHOTOGRAPHIC IMAGE FORMING APPARATUS CAPABLE OF SETTING IMAGE FORMING CONDITIONS AND METHOD FOR SETTING IMAGE FORMING CONDITIONS IN AN ELECTROPHOTOGRAPHIC IMAGE FORMING APPARATUS

BACKGROUND OF THE INVENTION

1. Field of the Invention

The present invention relates to an electrophotographic image forming apparatus.

2. Description of the Related Art

In image forming apparatuses of the electrophotographic type, e.g., copiers, when image formation is accomplished using a developing device with a two-component developer comprising a toner and a carrier, the carrier in the developing device becomes fatigued in conjunction with the increasing number of copies made, i.e., the increase in operating time of the developing device, thereby reducing the chargeability of the carrier relative to the toner. When the carrier chargeability is reduced, the amount of toner charge is reduced and causes fogging of images and airborne dispersion of toner within the image forming apparatus. Therefore, carrier has a set service period, and developer is replaced after a predetermined number of copies are made.

Regarding the photosensitive member, the layer thickness of the photosensitive layer decreases in conjunction with the increase in the number of copies made. When the thickness of the photosensitive layer decreases, the chargeability of the photosensitive member is reduced, which reduces the charging potential of the surface of the photosensitive member. In the case of digital copying apparatuses (reverse development), when the charging potential is reduced the difference between the charge potential and the developing bias voltage becomes smaller, which leads to fogging of the image. Therefore, the photosensitive member has a set service period, and the photosensitive member is replaced after a predetermined number of copies are made.

Since the actual service life of the carrier and photosensitive member differ depending on the usage of the apparatus, the service life of the components is not necessarily limited to the making of a predetermined number of copies. Since the number of copies specified for carrier and photosensitive member replacement is typically set low for safety, the components are replaced despite the fact they are still usable.

The replacement periods for developer and photosensitive member have been conventionally set as identical periods for both the developer and photosensitive member. When a preset service time arrived, a service person would visit the user and simultaneously replace both the developer and photosensitive member. It is actually quite unusual for the service life of developer and photosensitive member to be identical, although both are often replaced regardless of whether or not one or another of the developer or the photosensitive member is still usable.

SUMMARY OF THE INVENTION

An object of the present invention is to provide an improved image forming apparatus of the electrophotographic type which eliminates the previously described disadvantages.

Another object of the present invention is to provide an image forming apparatus of the electrophotographic type capable of using developer to the full limit of its service life.

A further object of the present invention is to provide an electrophotographic image forming apparatus of the electrophotographic type capable of using a photosensitive member to the full limit of its service life.

A still further object of the present invention is to provide an electrophotographic image forming apparatus of the electrophotographic type capable of using both developer and photosensitive member to the full limit of their service lives.

BRIEF DESCRIPTION OF THE DRAWINGS

These and other objects and features of the present invention will become apparent from the following description taken in conjunction with the preferred embodiments thereof with reference to the accompanying drawings, in which:

FIG. 6(*b*) is a graph which defines the fuzzy set of grid voltage Vg of an output control as a membership function;

FIG. 9(*b*) is a graph which defines the fuzzy set of grid voltage Vg of an output control as a membership function;

DETAILED DESCRIPTION OF THE PREFERRED EMBODIMENTS

A suitable embodiment of the present invention is described hereinafter with reference to the accompanying drawings.

Figure 1:
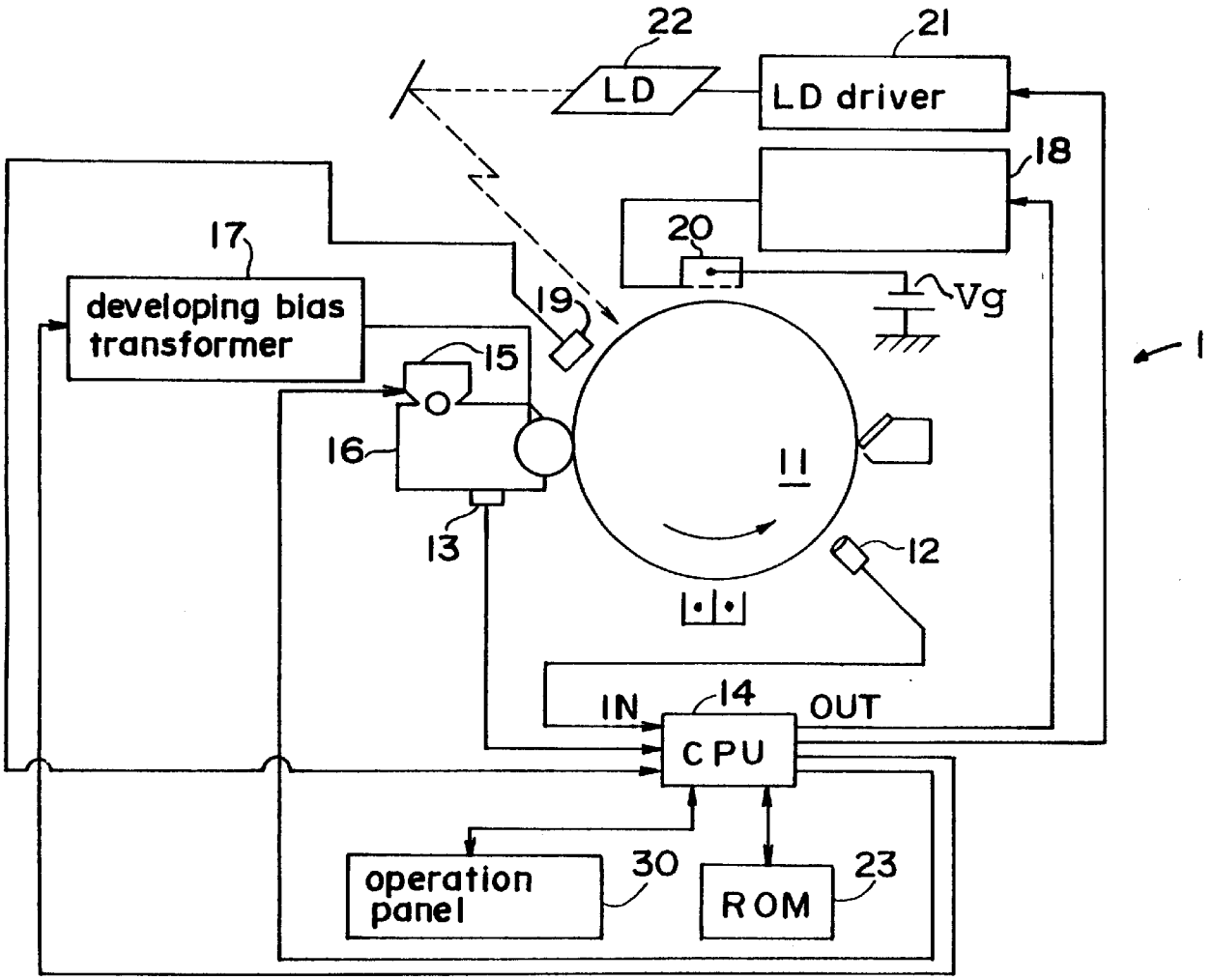
FIG. 1 briefly shows the construction of an embodiment of the image forming apparatus.

FIG. 1 briefly shows the construction of a digital copying apparatus 1, i.e., an electrophotographic image forming apparatus of the present invention. Digital copying apparatus 1 of the present embodiment has a well known construction for reading image data from documents and generating a copy image via an electrophotographic process based on the read image data.

Referring to FIG. 1, charger 20 is provided with a charging wire and grid, and is supplied with a discharge voltage to the charging wire via grid voltage transformer 18, and a grid voltage Vg to the grid wire. The surface of photosensitive drum 11 is charged to a potential identical to the grid potential via the application of a voltage to charger 20.

LD driver 21 drives semiconductor laser 22 based on document image data read by an image reader not shown in the drawing, so as to emit a laser beam therefrom. The laser beam emitted from semiconductor laser 22 irradiates the surface of photosensitive drum 11 which has been uniformly charged by said charger 20. Thus, the potential of the exposed region of the surface of photosensitive drum or photosensitive member 11 is reduced via said exposure, and an electrostatic latent image corresponding to the document image is formed on the surface of photosensitive drum 11.

Developing device 16 accommodates a two-component developer comprising a toner and a carrier, and mixes the toner and carrier via a mixing mechanism not shown in the drawing so as to charge the toner to a predetermined potential. The charged toner is transported to the developing position (a position confronting photosensitive drum 11) via a developing sleeve. In developing device 16 of the aforesaid construction, a predetermined developing bias voltage Vb is applied to the developing sleeve via developing bias transformer 17 to develop the electrostatic latent image formed on the surface of photosensitive drum 11 via the charged toner. In the digital copying apparatus 1 of the present embodiment, developing is accomplished by a reverse developing method wherein toner is adhered to the regions on the surface of photosensitive drum 11 which have reduced potential due to the aforesaid exposure by laser beam, and a predetermined amount of toner is adhered to the surface of photosensitive drum 11 in accordance with the difference between the developing bias voltage Vb and the surface potential Vi of photosensitive drum 11 after the aforesaid potential reduction, i.e., in accordance with the developing potential difference.

The toner image formed on photosensitive drum 11 by the previously described development is transferred onto a sheet (not illustrated) at a transfer section and thereafter fixed thereon at a fixing section not shown in the drawing.

Digital copying apparatus 1 is provided with a CPU 14 for controlling the operation of the previously mentioned components of the apparatus, and executing the potential setting process described below. ROM 23 and operation panel 30 are connected to CPU 14. Operation panel 30 comprises operation keys such as a print key to start the copy operation, and a display section for displaying various types of information.

Figure 2:
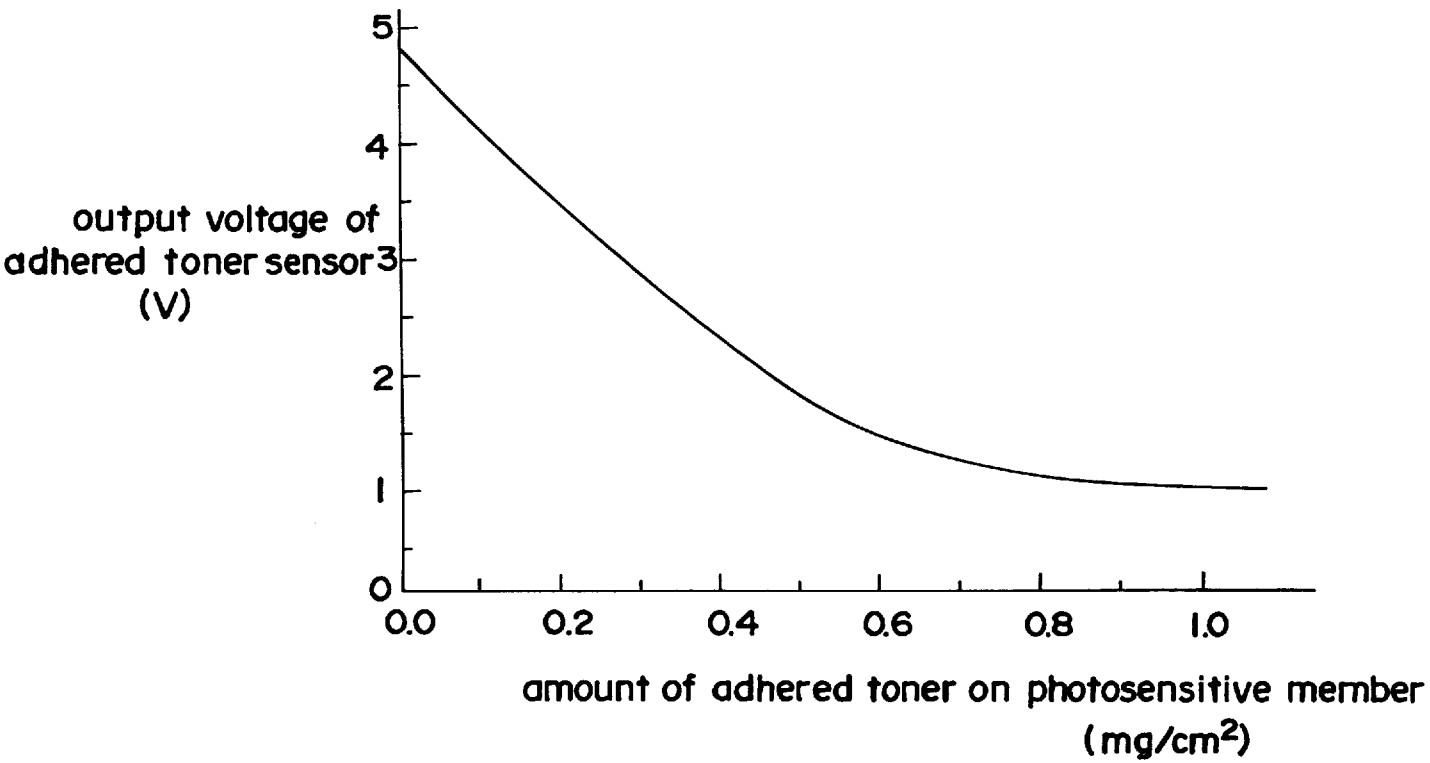
FIG. 2 is a graph showing an example of the relationship between the output voltage of the adhered toner sensor and the amount of adhered toner on the photosensitive member.
Figure 3:
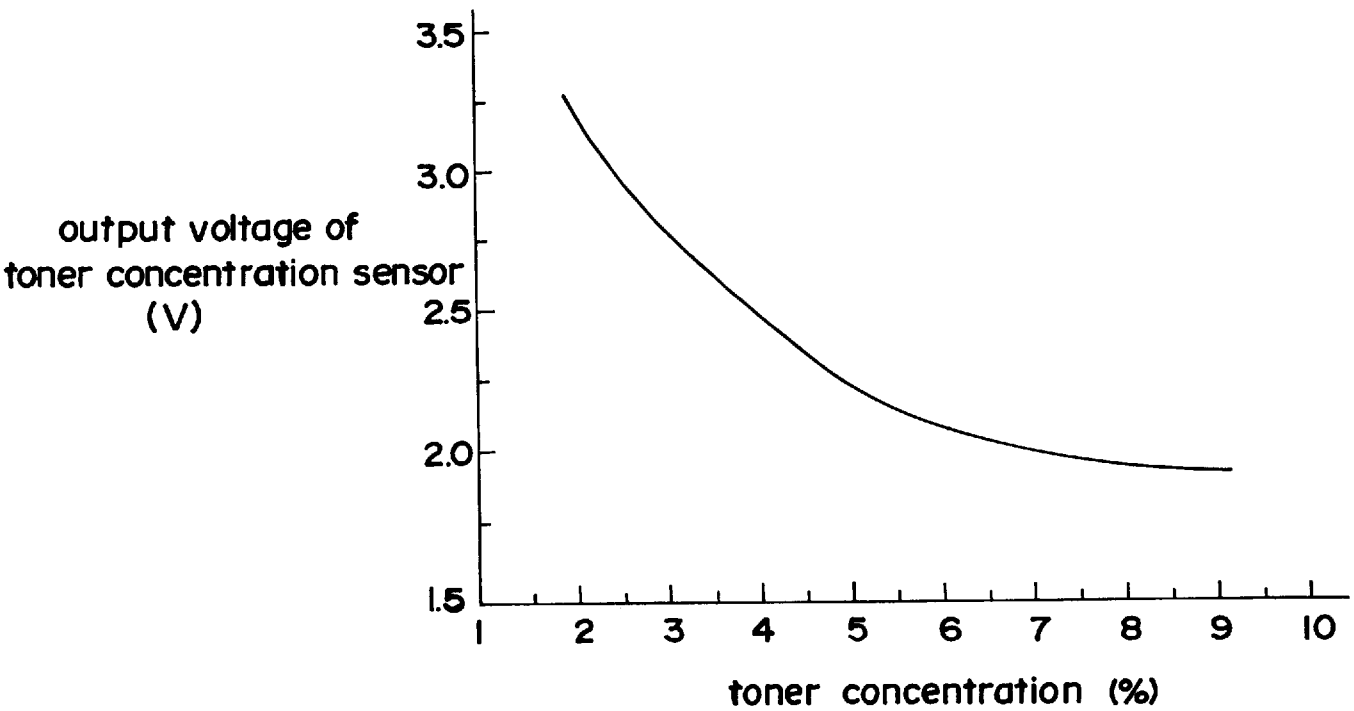
FIG. 3 is a graph showing an example of the relationship between the output voltage of the toner concentration sensor and the concentration of the toner in the developing device.

In digital copying apparatus 1 of the previously described construction, a toner test pattern is formed by predetermined conditions outside the image region of photosensitive drum 11 each time a copy is made, and the amount of light reflected from the test pattern region and the background region of photosensitive drum 11 (the area not exposed to laser light which maintains the charge potential V0 ) is detected by adhered toner sensor 12 (a reflective type photosensor). Adhered toner sensor 12 outputs a voltage corresponding to the amount of reflected light detected, and CPU 14 determines the amount of adhered toner on the background region of photosensitive drum 11 and on the test pattern region based on said detected voltage. FIG. 2 is a graph showing an example of the relationship between the amount of adhered toner on photosensitive drum 11 and the output voltage of adhered toner sensor 12. The fog condition of the image can be determined from the amount of adhered toner on the background region of the photosensitive drum, and the output image density can be determined from the amount of adhered toner of the test pattern region. A toner concentration sensor 13 (reflective type photosensor) is provided below developing device 16, such that the concentration of toner within the developing device (weight ratio of toner and carrier mix) can be monitored from the output of the toner concentration sensor 13. FIG. 3 is a graph showing an example of the relationship between toner concentration in the developing device and the output voltage of the toner concentration sensor 13. CPU 14 compares the output value from adhered toner sensor 12 based on the test pattern region to the output value of a predetermined standard amount of adhered toner, and resupplies toner from toner hopper 15 to developing device 16 so as to an amount of adhered toner in a maximum density area at the standard adhered toner amount.

In digital copying apparatus 1 of the present embodiment, the developing bias voltage Vb can be changed by developing bias transformer 17, so as to change the developing potential difference thereby. When the developing bias voltage Vb is changed, the grid voltage Vg is changed simultaneously so as to maintain a constant difference with the charging potential V0. The grid voltage Vg can be changed by grid voltage transformer 18, and the charging potential V0 of the surface of photosensitive drum 11 can be changed thereby. In the apparatus of the present embodiment, the grid voltage Vg can be consecutively changed from −620 V by which an initial target photosensitive member charging potential of −600 V is obtained to −850 V of upper limit value. Furthermore, the charging potential V0 of the surface of photosensitive drum 11 is detected by potential sensor 19.

The controls including the potential setting process executed in the digital copying apparatus 1 of the present embodiment are described below.

Figure 4:
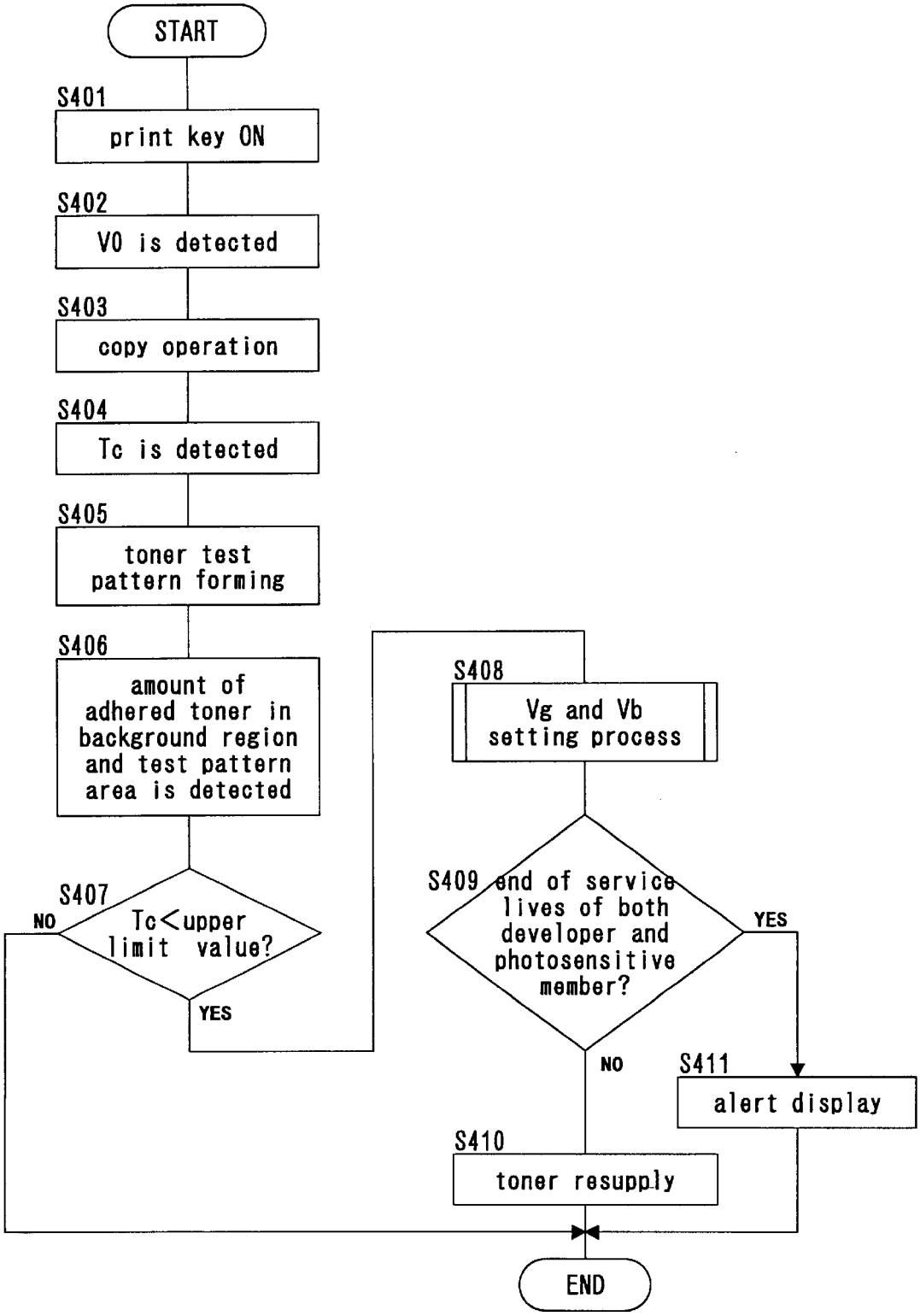
FIG. 4 is a flow chart showing the overall processes executed by the CPU 14.

FIG. 4 is a flow chart showing the overall processes executed by CPU 14.

When the print key on operation panel 30 is switched ON (step S401), charger 20 is switched On as photosensitive drum 11 is rotated, and the charging potential V0 of the surface of photosensitive drum 11 is detected by potential sensor 19 (step S402). After one cycle of the copy operation has been executed (step S403), the toner concentration Tc in the developing device 16 is detected by toner concentration sensor 13 (step S404). Then, a toner test pattern is formed under predetermined conditions outside the image area of photosensitive drum 11 (step S405), and the amount of adhered toner in the test pattern area and the amount of adhered toner in the background region of photosensitive drum 11 are detected by adhered toner sensor 12 (step S406).

Then, the toner concentration Tc detected in step S404 is compared with a predetermined upper limit toner concentration (8% in the present embodiment) (step S407). When the toner concentration Tc exceeds the upper limit value (step S407: NO), the subsequent steps are omitted and the present process is terminated. The aforesaid process is terminated because when the toner concentration exceeds the aforesaid upper limit value, fog appears in the output image in subsequent steps and said fog is due to excessive toner concentration rather than fatigue of the developer or photosensitive member.

On the other hand, when the toner concentration Tc is less than the upper limit value (step S407: YES), processes are executed to set the image forming conditions, i.e., the grid voltage Vg and the developing bias voltage Vb (step S408). The process of step S408 is a process which determines the condition of the developer and photosensitive member, and sets suitable grid voltage Vg and developing bias voltage Vb as described in detail later.

Then, a determination is made from the results of the process of step S408 as to whether or not both developer and photosensitive drum have reached the end of their service lives (step S409). If both are finished (step S409: YES), a message is displayed on the display section of operation panel 30 to alert the user (step S411). If, for example, a communications means such as a modem or the like is provided in the copying apparatus unit, a distant service center can be alerted via the telephone system to send service personnel to replace the expired components. On the other hand, when at least one or another of the developer or photosensitive member is still viable (step S409: NO), toner is resupplied from toner hopper 15 to developing device 16 based on the amount of adhered toner of the test pattern area detected by adhered toner sensor 12 (step S410).

Figure 5:
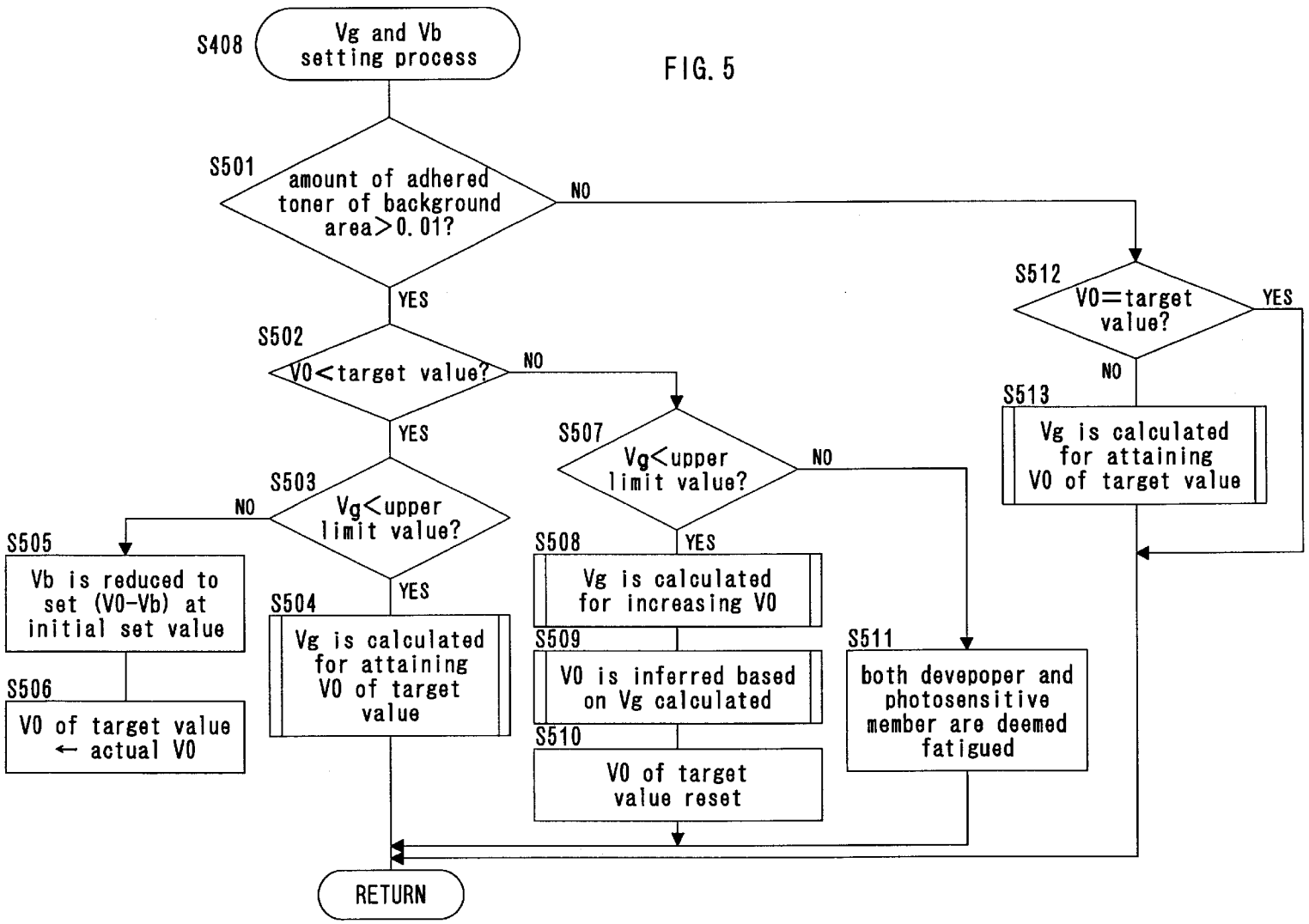
FIG. 5 is a flow chart showing the setting process of grid voltage Vg and developing bias voltage Vb.

FIG. 5 is a flow chart showing the grid voltage Vg and developing bias voltage Vb setting process executed in step S408.

First, the amount of adhered toner of the background area of the surface of photosensitive drum 11 detected by adhered toner sensor 12 in step S406 is compared with a reference amount (0.01 mg/cm$^2$ in the present embodiment) (step S501). If the amount of adhered toner is less than the reference amount (step S501: NO), the image is determined to be in excellent condition without fog generation, the displacement of the charging potential V0 of the surface of photosensitive drum 11 from a target value is corrected, and the process ends. That is, when the charging potential V0 of the surface of photosensitive drum 11 detected by potential sensor 19 deviates from a target value (step S512: NO), the grid voltage Vg for attaining a charging potential V0 of the target value is calculated using fuzzy logic (step S513). The process of step S513 is described later. When the charging potential V0 matches the target value (step S512: YES), the process ends directly.

On the other hand, when the amount of adhered toner of the background area of photosensitive drum 11 in step S501 is greater than said reference value (step S501: YES), it is determined that fog may be generated. In this case, the charging potential V0 of photosensitive drum 11 detected by potential sensor 19 is compared to a target value (initial value of −600 V) (step S502). When the charging potential V0 is less than a target value (step S502: YES), fog caused by photosensitive member (photosensitive layer of said member) fatigue is determined, and the grid voltage Vg is compared to an upper limit value (−850 V in the present embodiment) (step S503). When the grid voltage Vg is less than said upper limit value (step S503: YES), the grid value Vg is calculated using fuzzy logic so as to set the charging potential V0 at the target value (step S504). The content of the process of step S504 is identical to the content of the previously described process of step S513. When the grid voltage Vg attains an upper limit value in step S503 (step S503: NO), since the charging potential V0 cannot be elevated further and a process is executed to suppress fogging by maintaining a fog margin, i.e., the difference between charging potential V0 and developing bias voltage Vb by reducing said developing bias voltage Vb. Specifically, the developing bias voltage Vb is adjusted to set the difference between the charging potential V0 and the developing bias voltage Vb at an initial set value (S505). Thus, the toner concentration is elevated by minimizing the developing potential difference. In step S506, the target value of charging potential V0 is reset at a value of charging potential V0 actually detected by potential sensor 19 in step S502.

In step S502, when the charging potential V0 of photosensitive drum 11 exceeds the target value (step S502: NO), fog is generated regardless of maintaining a preset fog margin, and developer fatigue is inferred as the cause. Then, a process is executed to prevent fog by increasing the fog margin by increasing the charging potential V0. First, a check is made to determine whether or not the grid voltage Vg is less than an upper limit value (step S507). When the grid voltage Vg is less than an upper limit value (step S507: YES), the value of grid voltage Vg is determined by fuzzy logic so as to increase the value of charging potential V0 (step S508). Then, the value of the charging potential V0 obtained by the grid voltage Vg set in step S508 is inferred (step S509), and the inferred charging potential V0 is set as the target value (step S510). The processes of steps S508 and S509 are described later.

When the grid voltage Vg attains an upper limit value in step S507 (step S507: NO), both the developer and photosensitive member are deemed fatigued and the process ends (step S511).

The processes of steps S504 and S513 are described hereinafter.

(1) Overview

This process calculates the value of the grid voltage Vg using fuzzy logic to set the photosensitive member charging potential V0 at the target value.

The fuzzy logic used in this process is constructed by the following control rules.

When charging potential V0 is rather low, grid voltage Vg increases greatly;

When charging potential V0 is slightly low, grid voltage Vg increases slightly;

When charging potential V0 is suitable, grid voltage Vg does not change;

When charging potential V0 is slightly high, grid voltage Vg reduces slightly;

When charging potential V0 is rather high, grid voltage Vg reduces greatly.

(2) Fuzzy logic input and output

The state quantity as fuzzy logic input and control quantity as fuzzy logic output are as follows.

Input (state quantity): displacement from a target value of photosensitive member charging potential V0 detected by potential sensor 19;

Output (control quantity): amount of adjustment of the charging grid voltage Vg.

(3) Definition of membership functions

Figure 6:
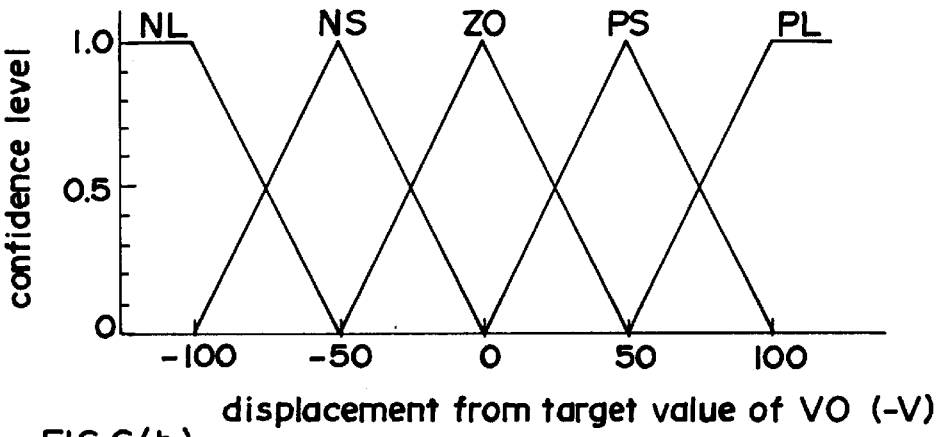
FIG. 6(*a*) is a graph which defines the fuzzy set of displacement from a target value of the photosensitive member charging potential V0 of an input condition as a membership function.
Figure 6:
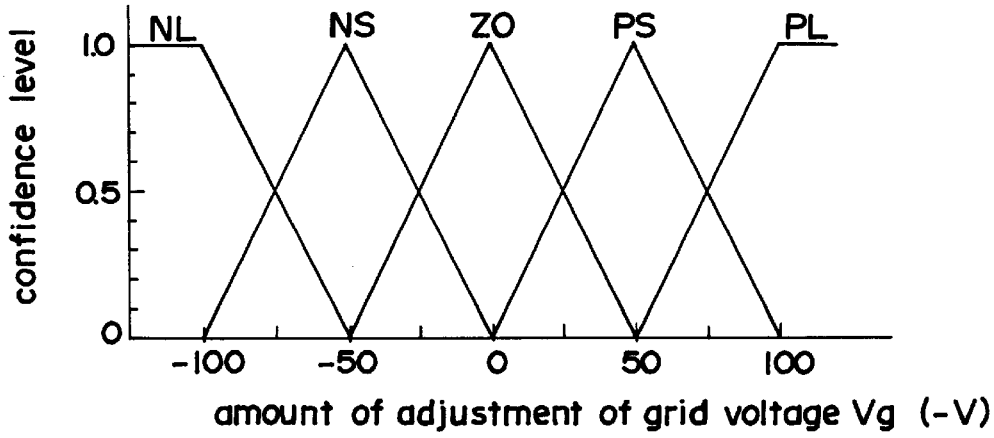

As shown in FIGS. 6(*a*) and 6(*b*), the fuzzy sets of the aforesaid state quantity (displacement of charging potential V0 from a target value) and control quantity (amount of adjustment of charging grid voltage Vg) are defined as membership functions.

The symbols used in the drawings are defined as follows.

FIG. 6(*a*)

NL: very negative
NS: Slightly negative
ZO: Standard
PS: Slightly positive
PL: Very positive
FIG. 6(*b*)
NL: Great descent
NS: Slight descent
ZO: No change
PS: Slight elevation
PL: Great elevation The vertical axis of each graph expresses the confidence level of the fuzzy sets of each symbol, and which expresses optional values in a range from 0 to 1.

Figure 7:
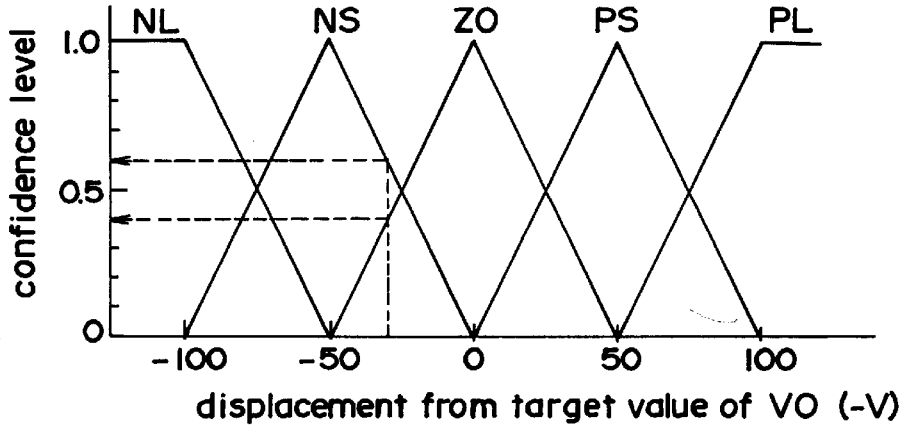
FIG. 7 shows the confidence level of each fuzzy set relative to specific input values in the membership function of displacement from a target value of the photosensitive member charging potential V0.

For example, when the target value of charging potential V0 is −600 V and the actual charging potential V0 detected by potential sensor 19 is −570 V, the displacement from the target value is −30 V, such that NS and ZO are selected as state quantities, and the confidence level of NS is 0.6 and the confidence level of ZO is 0.4, as shown in FIG. 7. Thus, the confidence levels of the respective states can be determined with respect to specific input values from the membership functions.

(4) Control rules

The control rules used in the aforesaid fuzzy logic are expressed as follows with respect to the amount of adjustment of grid voltage Vg and displacement of charging potential V0 from a target value.

There are five rules, which determine the control quantity relative to the aforesaid state quantity.

| Displacement of V0 from target | | Adj. of grid voltage Vg |
|---|---|---|
| ((1)) if NL | then | PL |
| ((2)) if NS | then | PS |
| ((3)) if ZO | then | ZO |
| ((4)) if PS | then | NS |
| ((5)) if PL | then | NL |

For example, when NS and ZO are selected as state quantities relative to a displacement of −30 V from the target value of charging potential V0 as described in section (3) above, both rules ((2)) and ((3)) are used.

(5) Calculation of control quantity

The control quantity is calculated using the min-max centroid method based on the control quantity membership function used in the control rule selected in section (4) above.

Determine the level of confidence of the control quantity for each rule selected;

Rule ((2))

Confidence level of displacement NS from V0 target value is 0.4

Thus, the assertion of rule ((2)) is that the confidence level of adjustment quantity PS of grid voltage Vg is 0.6

Rule ((3))

Confidence level of displacement ZO from V0 target value is 0.4

Thus, the assertion of rule ((3)) is that the confidence level of adjustment quantity ZO of grid voltage Vg is 0.4

Synthesis of control quantity confidence levels

Figure 8:
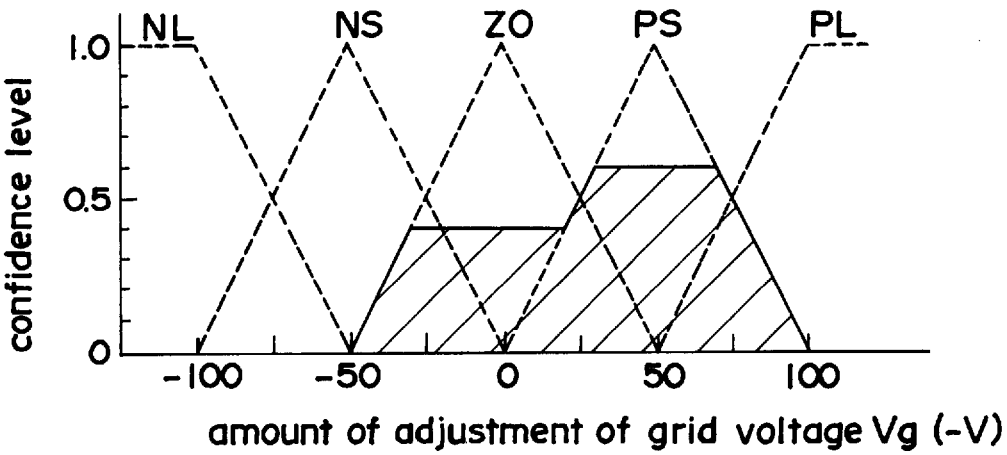
FIG. 8 shows the process for determining the amount of adjustment of the grid voltage Vg by the min-max centroid method based on the membership function.

FIG. 8 shows the respective state quantities of the membership functions of adjustments of grid voltage Vg truncated by the assertions of rules ((2)) and ((3)) , with the overlapping regions indicated by diagonal shading. The center of the shaded region determined by min-max centroid method becomes the control quantity and, in this instance, the amount of adjustment of grid voltage Vg is 30 V.

The contents of the process of the previously mentioned step S508 are described hereinafter.

(1) Overview

This process calculates the value of the grid voltage Vg using fuzzy logic to elevate the charging potential V0 so as to eliminate fog.

The fuzzy logic used in this process is constructed by the following control rules.

When there is no fog, grid voltage Vg does not change;
When there is slight fog, grid voltage Vg increases slightly;
When there is severe fog, grid voltage Vg increases greatly.

(2) Fuzzy logic input and output

The state quantity as fuzzy logic input and control quantity as fuzzy logic output are as follows.

Input (state quantity): amount of adhered toner on background area of photosensitive member detected by output from adhered toner sensor 12;

Output (control quantity): amount of adjustment of the charging grid voltage Vg.

(3) Definition of membership functions

Figure 9:
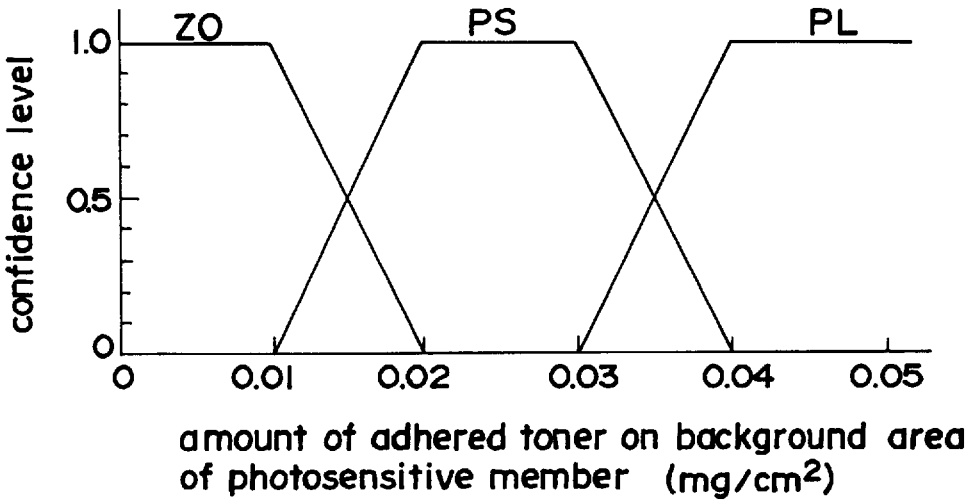
FIG. 9(*a*) is a graph which defines the fuzzy set of the amount of adhered toner on the background region of the photosensitive member of an input condition as a membership function.
Figure 9:
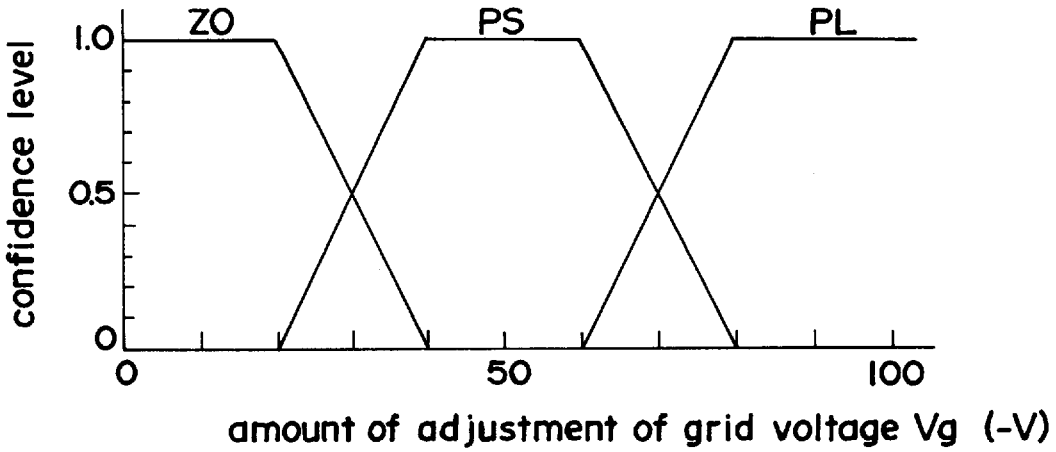

As shown in FIGS. 9(*a*) and 9(*b*), the fuzzy sets of the aforesaid state quantity (amount of adhered toner on background area of photosensitive member) and control quantity (amount of adjustment of charging grid voltage Vg) are defined as membership functions.

The symbols used in the drawings are defined as follows.

FIG. 9(*a*)
ZO: Standard
PS: Slight
PL: Severe
FIG. 9(*b*)
ZO: No change
PS: Slight elevation
PL: Great elevation The vertical axis of each graph expresses the confidence level of the fuzzy sets of each symbol, and which expresses optional values in a range from 0 to 1.

Figure 10:
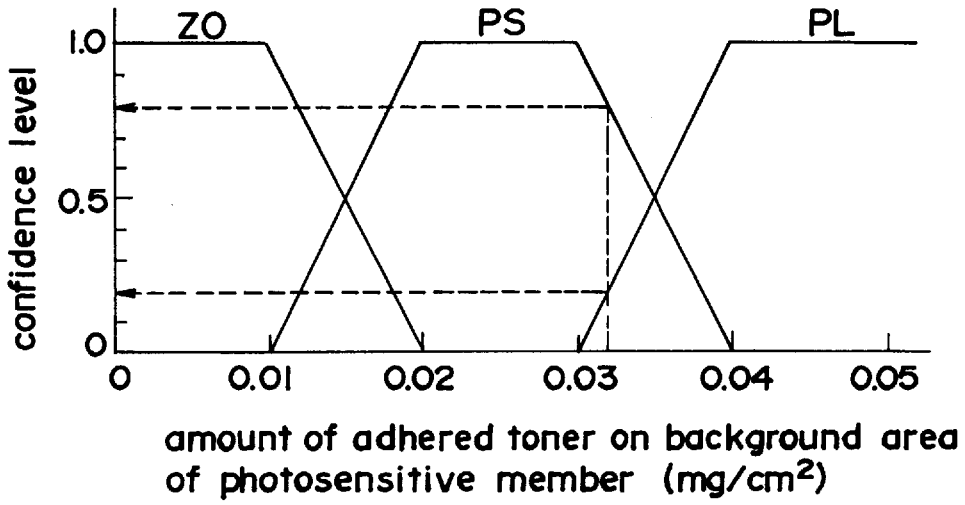
FIG. 10 shows the confidence level of each fuzzy set relative to specific input values in the membership function of the amount of adhered toner in the background region of the photosensitive member.

For example, when the amount of adhered toner on the background area of the photosensitive member is 0.032 ($mg/cm^2$), PS and PL are selected as the state quantities and the confidence level of PS is 0.8 and the confidence level of PL is 0.2, as shown in FIG. 10. Thus, the confidence levels of the respective states can be determined with respect to specific input values from the membership functions.

(4) Control rules

The control rules used in the aforesaid fuzzy logic are expressed as follows with respect to the amount of adjustment of grid voltage Vg and amount of adhered toner of the background area of photosensitive member.

There are three rules, which determine the control quantity relative to the aforesaid state quantity.

| Amt. of adhered toner on background area of photosensitive member | | Adj. of grid voltage Vg |
|---|---|---|
| ((1)) if ZO | then | ZO |
| ((2)) if PS | then | PS |
| ((3)) if PL | then | PL |

For example, when PS and PL are selected as the state quantities relative to an amount of 0.032 ($mg/cm^2$) of adhered toner on the background area of the photosensitive member, both rules ((2)) and ((3)) are applied.

(5) Calculation of control quantity

The control quantity is calculated using the min-max centroid method based on the control quantity membership function used in the control rule selected in section (4) above.

Determine the level of confidence of the control quantity for each rule selected;

Rule ((2))

Confidence level of amount of toner adhered to background of photosensitive member PS is 0.8

Thus, the assertion of rule ((2)) is that the confidence level of adjustment quantity PS of grid voltage Vg is 0.8

Rule ((3)) Confidence level of amount of toner adhered to background of photosensitive member PL is 0.2

Thus, the assertion of rule ((3)) is that the confidence level of adjustment quantity PL of grid voltage Vg is 0.2

Synthesis of control quantity confidence levels

Figure 11:
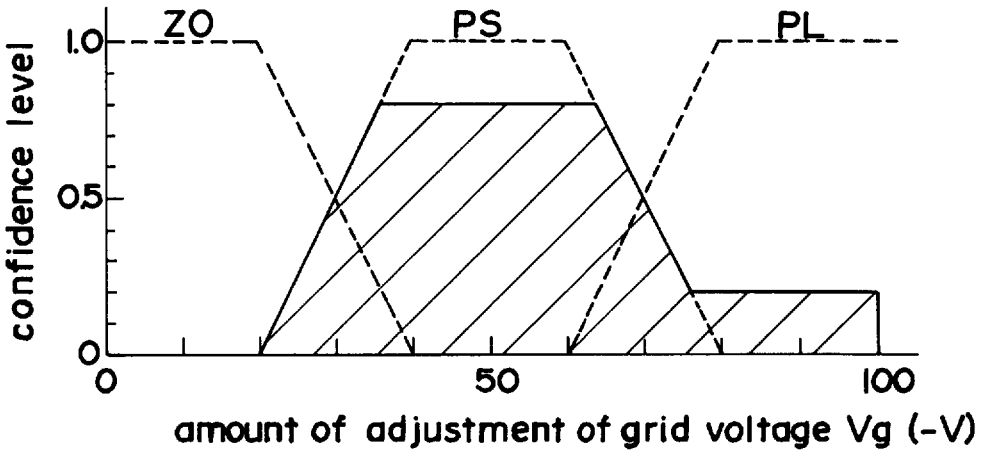
FIG. 11 shows the process for determining the amount of adjustment of the grid voltage Vg by the min-max centroid method based on the membership function.

FIG. 11 shows the respective state quantities of the membership functions of adjustments of grid voltage Vg truncated by the assertions of rules ((2)) and ((3)) , with the overlapping regions indicated by diagonal shading. The center of the shaded region determined by min-max centroid method becomes the control quantity and, in this instance, the amount of adjustment of grid voltage Vg is 55 V.

The contents of the process of the previously mentioned step S509 are described hereinafter.

Figure 12:
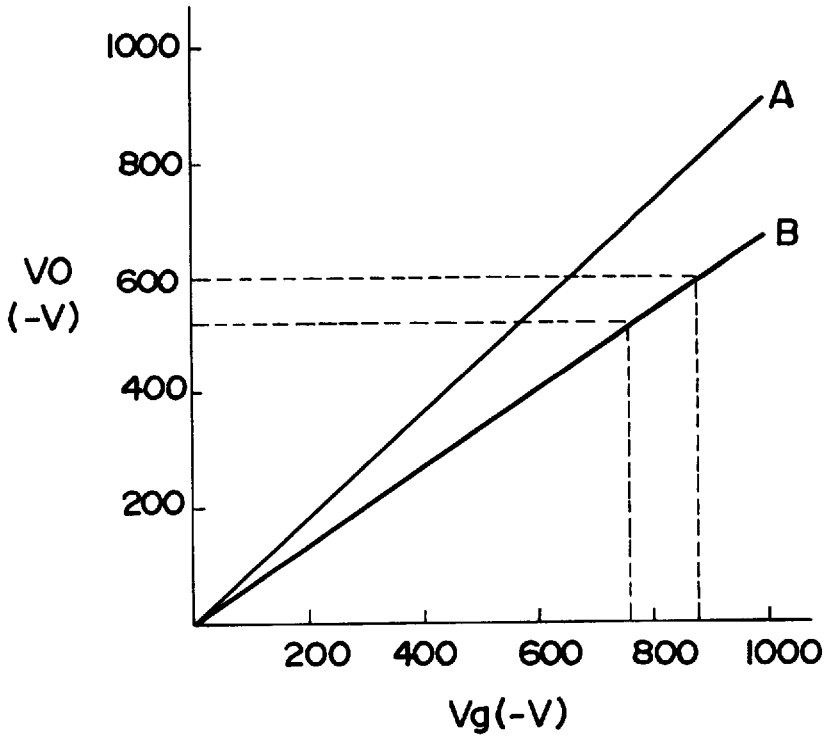
FIG. 12 is a graph showing the relationship between the grid voltage Vg and the photosensitive member charging potential V0 obtained thereby.

This process infers the photosensitive member charging potential V0 obtained from the grid voltage Vg calculated in step S508. FIG. 12 is a graph showing the relationship between the grid voltage Vg and the photosensitive member charging potential V0 obtained therefrom. Grid voltage Vg and charging potential V0 have a linear relationship, which is expressed by line A in the drawing in the initial state. This relationship fluctuates in accordance with environmental fluctuations, and reduction of the photosensitive layer thickness with repeated operation in the apparatus. For example, when the charging potential V0 is −520 V when the grid voltage Vg is −760 V during a repeated use, the relationship between the grid voltage Vg and charging potential V0 is linear as indicated by the line B in FIG. 12. When the grid voltage Vg is set at −880 V, the inferred charging potential V0 is set at −600 V, as indicated by the dashed line in FIG. 12.

In the digital copying apparatus 1 of the present embodiment as described above, when the toner concentration in the developing device is less than an upper limit value and the amount of adhered toner in the background area of the photosensitive member exceeds a standard amount, it is determined that fog will appear in the output image, then a determination is made as to whether or not said fog is caused by fatigue of the photosensitive member (photosensitive layer), or fatigue of the developer (carrier) by determining whether or not the photosensitive member charging potential V0 has attained a target value. Then, the fog is prevented by changing the image forming conditions (potential setting) by adjusting the grid voltage Vg and developing bias voltage Vb in accordance with the aforesaid determination result. Accordingly, even when one or another of the photosensitive member or developer is fatigued, the apparatus of the present embodiment provides that the quality of the output image can be maintained by changing the potential setting so as to increase the load on the unfatigued component so long as at least one of another component is not fatigued. Thus, both the photosensitive member and developer can be used to the limits of their service lives.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless otherwise they depart therefrom.

Although the control quantity is calculated using the min-max centroid method in the previously described embodiment, it is to be noted that the control quantity may be calculated using a simplified logic method which defines the later conditions of the logic rules as constants without fuzzy logic and calculates the control quantity by weighted mean, or a method which uses different logic methods such as a function type logic that defines the later conditions as functions. Furthermore, the form of the membership functions and the content and number of logic rules may be modified based on experience and experimental results.

Although the preferred embodiment has been described in terms of an apparatus of the reverse developing type, it is to be noted that the present invention is not limited to the aforesaid application and is further applicable to apparatuses which use standard developing methods to adhere toner to areas of a sensitive member having non-reduced potential due to optical exposure. In this instance, the developing bias voltage Vb may be increased, for example, relative to fog caused by photosensitive member fatigue, and the photosensitive member decay potential Vi may be reduced (optical exposure elevation), for example, relative to fog caused by developer fatigue.

Whereas the aforesaid embodiment has been discussed in terms of a digital copying apparatus, it is to be understood that the present invention is not limited to such apparatuses and is further applicable to all image forming apparatuses of the electrophotographic type, including laser printers, analog copying apparatuses and the like.

What is claimed is:

1. An image forming apparatus of the electrophotographic type for forming images by a reverse developing method, said image forming apparatus comprising:

an electrostatic latent image carrying member;

charging means for charging the surface of said carrying member to a predetermined potential;

charging voltage application means for applying a charging voltage to said charging means, said charging voltage being variable in a range defined by an upper limit value;

exposure means for forming an electrostatic latent image by optically exposing the surface of said carrying member charged by said charging means to reduce a potential of an image region;

a developing device for accommodating a developer including toner and carrier, and for forming a toner image on the surface of said carrying member by developing said electrostatic latent image with toner;

potential detecting means for detecting a surface potential of said carrying member charged by said charging means;

toner detecting means for detecting an amount of toner adhered to a background region of the carrying member by developing; and control means for repeatedly executing charge voltage control which includes:

first judgement for judging whether an adhered toner amount detected by said toner detecting means is in excess of a standard amount;

second judgement for judging whether the surface potential of said carrying member detected by said potential detecting means is less than a target value; and adjustment for increasing the charging voltage so as to attain said target value for the surface potential of the carrying member when both of the first and second judgement show positive.

2. The image forming apparatus as claimed in claim 1, further comprising bias voltage application means for applying a variable developing bias voltage between said developing device and said carrying member, wherein said control means further executes developing bias voltage control which includes;

third judgement for judging whether said charging voltage increased by said charge voltage control attains said upper limit value;

adjustment for reducing the developing bias voltage so as to set the difference between the detected surface potential of the carrying member and the developing bias voltage at an initial value instead of said charging voltage adjustment when the third judgement show positive.

3. The image forming apparatus as claimed in claim 2, wherein said developing bias voltage control further includes a reset for resetting the surface potential of the carrying member detected by said potential detecting means to said target value for said second judgement.

4. The image forming apparatus as claimed in claim 1, wherein said control means calculates the amount of increase of the charging voltage using fuzzy logic.

5. The image forming apparatus as claimed in claim 1, further comprising toner concentration detecting means for detecting the toner concentration of the developer in said developing device, wherein said control means executes the charge voltage control only when the detected toner concentration is less than a predetermined value.

6. An image forming apparatus of the electrophotographic type for forming images by a reverse developing method, said image forming apparatus comprising:

an electrostatic latent image carrying member;

charging means for charging a surface of said carrying member to a predetermined potential;

charging voltage application means for applying a charging voltage to said charging means;

exposure means for forming an electrostatic latent image by optically exposing the surface of said carrying member charged by said charging means to reduce a potential of an image region;

a developing device for accommodating a developer including toner and carrier, and for forming a toner image on the surface of said carrying member by developing said electrostatic latent image with toner;

potential detecting means for detecting the surface potential of said carrying member charged by said charging means;

toner detecting means for detecting an amount of toner adhered to a background region of the carrying member by developing; and control means for repeatedly executing charge voltage control which includes:

first judgement for judging whether the amount of adhered toner detected by said toner detecting means is in excess of a standard amount;

second judgement for judging whether the surface potential of said carrying member detected by said potential detecting means is less than a target value; and adjustment for increasing the charging voltage based on the amount of adhered toner in the background region of the carrying member when the first judgement show positive and the second judgement show negative.

7. The image forming apparatus as claimed in claim 6, wherein said charge voltage control includes a reset for resetting said target value for the second judgement based on the charging voltage increased in said adjustment.

8. The image forming apparatus as claimed in claim 6, wherein said control means calculates the amount of increase of the charging voltage using fuzzy logic.

9. The image forming apparatus as claimed in claim 6, further comprising toner concentration detecting means for detecting the toner concentration of the developer in said developing device, wherein said control means executes the charge voltage control only when the detected toner concentration is less than a predetermined value.

10. An image forming apparatus of the electrophotographic type for forming images by a reverse developing method, said image forming apparatus comprising:

an electrostatic latent image carrying member;

charging means for charging a surface of said carrying member to a predetermined potential;

charging voltage application means for applying a charging voltage to said charging means, said charging voltage being variable in a range defined by an upper limit value;

exposure means for forming an electrostatic latent image by optically exposing the surface of said carrying member charged by said charging means to reduce a potential of an image region;

a developing device for accommodating a developer including toner and carrier, and for forming a toner image on the surface of said carrying member by developing said electrostatic latent image with toner;

bias voltage application means for applying a variable developing bias voltage between said developing device and said carrying member;

potential detecting means for detecting the surface potential of said carrying member charged by said charging means;

toner detecting means for detecting an amount of toner adhered to a background region of the carrying member by developing; and control means for repeatedly executing charge voltage control and developing bias voltage control which include;

first judgement for judging whether the amount of adhered toner detected by said toner detecting means is in excess of a standard amount;

second judgement for judging whether the surface potential of said carrying member detected by said potential detecting means is less than a target value;

third judgement for judging whether said charging voltage attains said upper limit value;

adjustment for increasing the charging voltage so as to attain said target value for the surface potential of the carrying member when both of the first and second judgement show positive and the third judgement shows negative, for reducing the developing bias voltage so as to set the difference between the detected surface potential of the carrying member and the developing bias voltage at an initial value and resetting the surface potential of the carrying member detected by said potential detecting means to said target value for said second judgement when all of the first, second and third judgement show positive, for increasing the charging voltage based on the amount of adhered toner in the background region of the carrying member and resetting said target value for the second judgement based on the charging voltage increased in said adjustment when the first judgement shows positive and both of the second and third judgement show negative, and for determining the end of the service life of both the carrying member and developer when both of the first and third judgement show positive and the second judgement shows negative.

11. The image forming apparatus as claimed in claim 10, wherein said control means further executes control which includes;

fourth judgement for judging whether the surface potential of the carrying member detected by the potential detecting means matches said target value when the second judgement shows positive; and adjustment for increasing the charging voltage so as to set the surface potential of the carrying member at said target value when the fourth judgement shows negative.

12. The image forming apparatus as claimed in claim 10, wherein said control means calculates the amount of adjustment of the charging voltage using fuzzy logic.

13. The image forming apparatus as claimed in claim 10, further comprising toner concentration detecting means for detecting the toner concentration of the developer in said developing device, wherein said control means executes the charge voltage control and developing bias voltage control only when the detected toner concentration is less than a predetermined value.

14. The image forming apparatus as claimed in claim 10, further comprising alarm means for alerting a user to the end of service life of both the latent image carrying member and the developer.

15. An image forming apparatus of the electrophotographic type comprising:

an electrostatic latent image carrying member;

charging means for charging the surface of said carrying member to a predetermined potential;

charging voltage application means for applying a charging voltage to said charging means;

exposure means for forming an electrostatic latent image by optically exposing a surface of said carrying member charged by said charging means to reduce a potential of an image region;

a developing device for accommodating a developer including toner and carrier, and for forming a toner image on the surface of said carrying member by developing said electrostatic latent image with toner;

bias voltage application means for applying a variable developing bias voltage between said developing device and said carrying member;

potential detecting means for detecting a surface potential of said carrying member charged by said charging means;

toner detecting means for detecting an amount of toner adhered to a background region of the carrying member by developing; and control means for selectively performing an adjustment for one or another of either a surface potential setting of the carrying member or the developing bias voltage in accordance with the surface potential of the carrying member detected by said potential detecting means when the amount of adhered toner detected by the toner detecting means is in excess of a standard amount.

16. The image forming apparatus as claimed in claim 15, wherein said control means adjusts a developing bias voltage when the surface potential of the carrying member detected by said potential detecting means is less than a target value, and adjusts the surface potential setting of the latent image carrying member when the surface potential of the carrying member detected by said potential detecting means attains the target value.

17. The image forming apparatus as claimed in claim 16, wherein said control means resets said target value of the surface potential of the carrying member in accordance with the surface potential setting and the developing bias voltage after said adjustment.

18. The image forming apparatus as claimed in claim 17, wherein said control means determines the end of the service lives of both the carrying member and developer when the surface potential of the carrying member detected by said potential detecting means attains said target value and the amount of change of the surface potential setting of the carrying member attains a predetermined upper limit.

19. The image forming apparatus as claimed in claim 18, further comprising alarm means for alerting a user to the end of service life of both the latent image carrying member and the developer.

20. The image forming apparatus as claimed in claim 15, further comprising toner concentration detecting means for detecting the toner concentration of the developer in said developing device, wherein said control means executes said adjustment for the surface potential setting and the developing bias voltage only when the detected toner concentration is less than a predetermined value.

21. A method of setting image forming conditions in an electrophotographic image forming apparatus comprising the following steps of:

a first step for charging a surface of a latent image carrying member to a predetermined potential, and for forming an electrostatic latent image by optically exposing the charged surface of said carrying member to reduce a potential of an image region;

a second step for detecting a charge potential of the surface of said carrying member;

a third step for forming a toner image on the surface of said carrying member by developing the electrostatic latent image with toner;

a fourth step for comparing an amount of toner adhered to a background region of the carrying member by developing with a standard amount; and a fifth step for selectively performing an adjustment for one or another of either a charge potential setting of the carrying member or a developing bias voltage in accordance with the charge potential of the carrying member detected in the second step when the amount of toner adhered to the background region of said carrying member is in excess of said standard amount.

22. The method of setting image forming conditions as claimed in claim 21, wherein, in said fifth step, the developing bias voltage is adjusted when the charge potential of the carrying member detected in said second step is less than a target value, and the charge potential setting of the carrying member is adjusted when the charge potential of the carrying member attains the target value.

23. The method of setting image forming conditions as claimed in claim 22, further comprising a sixth step for resetting said target value of the carrying member charge potential in accordance with the charge potential setting and the developing bias voltage after the adjustment in said fifth step.

24. The method of setting image forming conditions as claimed in claim 23, further comprising a seventh step for determining the end of the service lives of both the carrying member and developer when the charge potential of said carrying member detected in said second step attains said target value and the amount of change of the charge potential setting of said carrying member attains an upper limit.

25. The method of setting image forming conditions as claimed in claim 21, wherein, in said fifth step, said adjustment for the charge potential setting and the developing bias voltage is executed only when the toner concentration of developer accommodated in developing device is less than a predetermined value.

26. An image forming apparatus of the electrophotographic type comprising:

an electrostatic latent image carrying member;

charging means for charging the surface of said carrying member to a predetermined potential;

charging voltage application means for applying a charging voltage to said charging means;

exposure means for forming an electrostatic latent image by optically exposing a surface of said carrying member charged by said charging means to reduce a potential of an image region;

a developing device for accommodating a developer including toner and carrier, and for forming a toner image on the surface of said carrying member by developing said electrostatic latent image with toner;

bias voltage application means for applying a variable developing bias voltage between said developing device and said carrying member;

fog detecting means for detecting an appearance of fog in an output image;

fatigue determining means for determining whether the fog is caused by fatigue of the carrying member or fatigue of the developer; and potential setting means for selectively adjusting one or another of either a surface potential setting of the carrying member or a developing bias voltage in accordance with a result of determination by said fatigue determining means when the appearance of fog is detected by said fog detecting means.

27. The image forming apparatus as claimed in claim 26, wherein said potential setting means adjusts the developing bias voltage when said fatigue determining means determines that the fog is caused by fatigue of the carrying member, and adjusts the surface potential setting of the carrying member when the fog is caused by fatigue of the developer.

28. The image forming apparatus as claimed in claim 27, wherein said fog detecting means includes toner concentration detecting means for detecting the toner concentration of the developer in said developing device, toner detecting means for detecting an amount of toner adhered to a background of the surface of the carrying member by developing and control means for determining that the fog appears in an output image when toner concentration detected by said toner concentration detecting means is less than a predetermined value and the amount of adhered toner detected by said toner detecting means is in excess of a standard amount.

29. The image forming apparatus as claimed in claim 28, wherein said fatigue determining means includes a potential detecting means for detecting the surface potential of said carrying member charged by said charging means, and control means for determining the fog is caused by fatigue of the carrying member when the appearance of fog is detected by said fog detecting means and the surface potential of the carrying member detected by said potential detecting means is less than a target value, and determining the fog is caused by fatigue of the developer when the appearance of fog is detected and the surface potential of the carrying member attains said target value.

* * * * *